US008607672B2

(12) United States Patent
Urick et al.

(10) Patent No.: US 8,607,672 B2
(45) Date of Patent: Dec. 17, 2013

(54) SEIZED FASTENER REMOVAL TOOL AND SET

(75) Inventors: Vincent J. Urick, Paxinos, PA (US); Scotty R. Kurtz, Clarinda, IA (US)

(73) Assignee: Lisle Corporation, Clarinda, IA (US)

( * ) Notice: Subject to any disclaimer, the term of this patent is extended or adjusted under 35 U.S.C. 154(b) by 252 days.

(21) Appl. No.: 13/288,667

(22) Filed: Nov. 3, 2011

(65) Prior Publication Data

US 2012/0055293 A1 Mar. 8, 2012

Related U.S. Application Data

(63) Continuation-in-part of application No. 12/715,210, filed on Mar. 1, 2010, now Pat. No. 8,272,299.

(60) Provisional application No. 61/529,651, filed on Aug. 31, 2011.

(51) Int. Cl.

| | |
|---|---|
| ***B25B 13/06*** | (2006.01) |
| ***B25B 13/48*** | (2006.01) |
| ***B25B 19/00*** | (2006.01) |
| ***B25D 17/02*** | (2006.01) |

(52) U.S. Cl.
USPC ..... 81/121.1; 81/53.2; 29/426.5

(58) Field of Classification Search
USPC ..... 81/53.2, 121.1, 125, 436, 463, 465, 81/466; 173/90, 91; 29/426.5
See application file for complete search history.

(56) References Cited

U.S. PATENT DOCUMENTS

| | | | | |
|---|---|---|---|---|
| 985,087 | A | 2/1911 | Wilson | |
| D142,054 | S | 8/1945 | Young | |
| 2,507,167 | A | 5/1950 | Lemmerman | |
| 2,936,010 | A | 5/1960 | Ansingh | |
| 3,087,364 | A * | 4/1963 | Witmer | 81/52 |
| 3,666,023 | A | 5/1972 | Sakamoto | |
| 4,794,830 | A | 1/1989 | Gross et al. | |
| 4,805,495 | A | 2/1989 | Tauber | |
| D359,669 | S | 6/1995 | Splingaire | |
| 5,526,722 | A | 6/1996 | Limehouse | |
| 5,638,909 | A | 6/1997 | Henderson | |
| 5,791,208 | A | 8/1998 | Grubbs | |
| 6,481,084 | B2 * | 11/2002 | Pool et al. | 29/426.1 |
| 6,609,577 | B2 | 8/2003 | Beccu | |
| 7,077,037 | B2 | 7/2006 | Shevela et al. | |
| 7,089,833 | B2 | 8/2006 | Hamann et al. | |
| 7,712,838 | B2 | 5/2010 | Walker et al. | |

OTHER PUBLICATIONS

USPTO Office Action dated Mar. 12, 2012, U.S. Appl. No. 12/715,210.

* cited by examiner

*Primary Examiner* — David B Thomas
(74) *Attorney, Agent, or Firm* — Banner & Witcoff, Ltd.

(57) ABSTRACT

A tool may loosen seized bolts by sending shock waves into the bolt shank and thread areas via axial blows with a pneumatic hammer on the center of the bolt head prior to removal. The tool may allow impacts to be centered on the bolt head without damaging the bolt head or without worry of the bit jumping off the bolt. The tool may be comprised of a separate driver and one or more sockets.

45 Claims, 4 Drawing Sheets

FIG.1
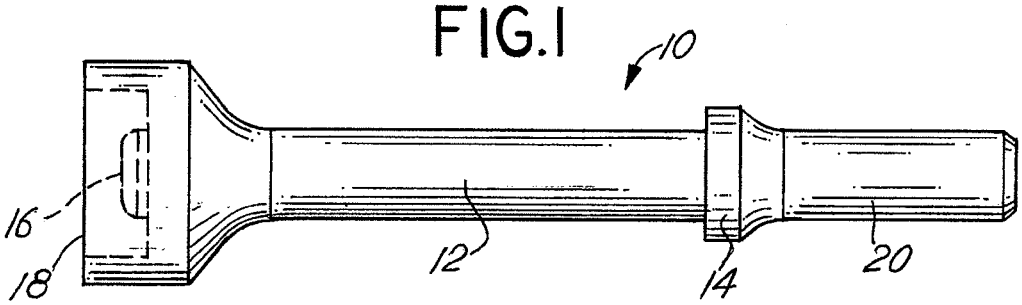
FIG.2
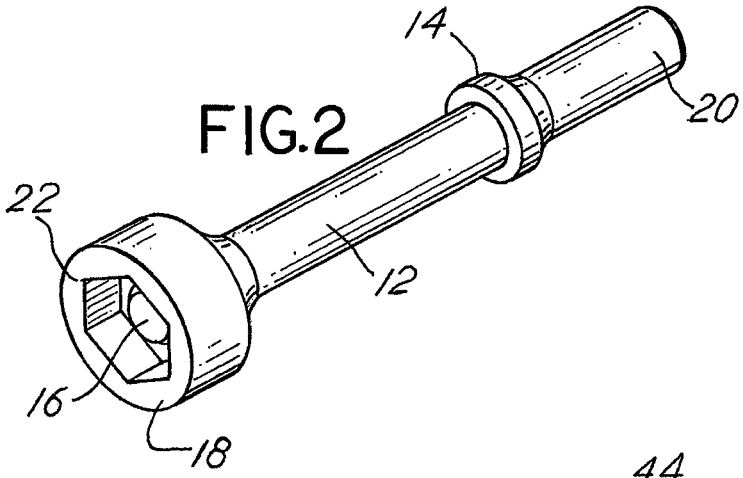
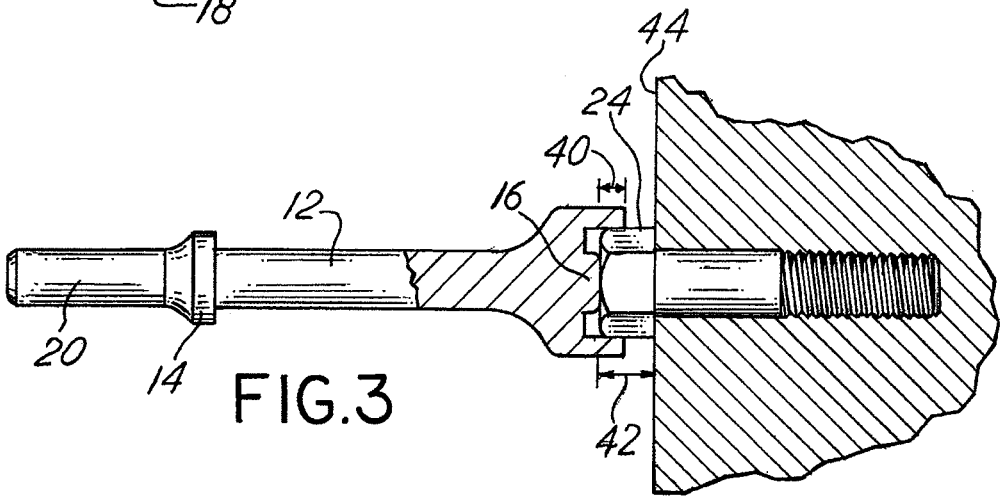
FIG.3

SEIZED FASTENER REMOVAL TOOL AND SET

CROSS REFERENCE TO RELATED APPLICATIONS

This is a continuation-in-part application of application Ser. No. 12/715,210 entitled "Tool for Freeing Seized Bolts" having a filing date of Mar. 1, 2010 which is incorporated herewith by reference and for which priority is claimed and a utility application incorporating by reference and claiming priority to U.S. Provisional Application Ser. No. 61/529,651 entitled "Seizing Fastener Removal Tool and Set filed on Aug. 31, 2011.

BACKGROUND OF THE INVENTION

The present invention relates to apparatus and methods for freeing seized bolts and, more particularly, to an air hammer bit that may loosen seized bolts by impacting bolt head centers. Also disclosed is a tool kit for loosening variously sized bolts and fasteners by impacting the heads thereof.

Presently, there are many components in the automotive industry and elsewhere that are being manufactured from lightweight metals, especially aluminum, because of its weight and strength. Steel bolts, however, continue to be used as fasteners for these components. When steel bolts pass through or are threaded into aluminum or other lightweight metal parts, the steel bolts can become seized over time due to galvanic reactions between the two different metals. These bolts often become difficult to remove usually resulting in damage to the bolt or to the component. Frustrated technicians will strike the head of a seized bolt with a punch or hammer in an attempt to loosen them.

Pneumatic hammers have also been used with a punch bit, usually resulting in the bit jumping off the bolt head and damaging the hex head of the bolt, making it hard to fit a wrench or socket to it again. The majority of the impacts from these punch bits hit squarely on the head of the bolt, transferring the shocks to the metal at the circumferential base of the bolt head, greatly absorbing and reducing the effect of the impact force instead of concentrating impacts on the center of the bolt head, where the impacts may be more effective in being transferred to the shank and threads of the bolt, thereby breaking up rust and corrosion. Many components in the automotive, construction and other fields are ruined due to failed attempts to extract seized bolts. Parts replacement and labor costs increase as a result.

As can be seen, there is a need for a tool that may apply an impact on the center of a bolt head without slipping off the bolt head and damaging the bolt.

Further, many impact tools are designed so that one size is expected to accommodate multiple sizes of fasteners. As a consequence, the tools have limited utility inasmuch as the ability to remove multiple sizes of fasteners is often difficult to accomplish with a single tool. As a consequence, there has developed a need for a set of tools which will enable removal of various sizes and shapes of fasteners.

SUMMARY OF THE INVENTION

In one aspect of the present invention, a tool comprises a front end attached to a shaft; an opening in the front end, the opening fitting about a bolt head; and a raised convex center in the opening, wherein the raised convex center contacts a bolt head when the bolt head is placed within the opening.

In another aspect of the present invention, a tool comprises a front end attached to a first end of a main shaft; a stub shaft attached to a second, opposite end of the main shaft; and a raised tool flare is disposed about the shaft, wherein the front end fits within an engagement opening in a bolt head.

In a further aspect of the present invention, a method for freeing seized bolts comprises attaching a tool to a pneumatic hammer, the tool having a front end attached to a shaft; an opening in the front end, and a raised convex center in the opening; fitting the opening about a bolt head; and activating the pneumatic hammer to cause the raised convex center to strike the bolt head.

As a further aspect of the invention alternative embodiments provide for a tool comprising a driver or drive shaft and a separate socket element that may be used in combination with the driver. In this manner, multiple distinctly sized socket elements that are each compatible with a single size driver may be provided. The individual sockets or socket elements may thus be customized to remove fasteners having a specific size and configuration. Various separate socket elements comprise a set of tool components which may be used in combination with a single size driver member.

These and other features, aspects and advantages of the present invention will become better understood with reference to the following drawings, description and claims.

BRIEF DESCRIPTION OF THE DRAWINGS

FIG. 1 is a side view of a tool according to an embodiment of the present invention;

FIG. 2 is a perspective view of the tool of FIG. 1;

FIG. 3 is a partial cross-sectional view of the tool of FIG. 1 in use;

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, an embodiment of the present invention provides a tool that may loosen seized bolts by sending shock waves into the bolt shank and thread areas via axial blows from a pneumatic hammer on the center of the bolt head prior to removal. The tool, according to an embodiment of the invention, may allow impacts to be centered on the bolt head without damaging the bolt head or without worry of the bit jumping off the bolt.

Figure 4:
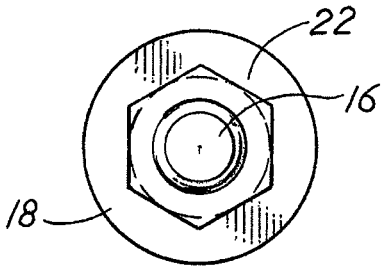
FIG. 4 is a front view of the tool of FIG. 1.
Figure 6:
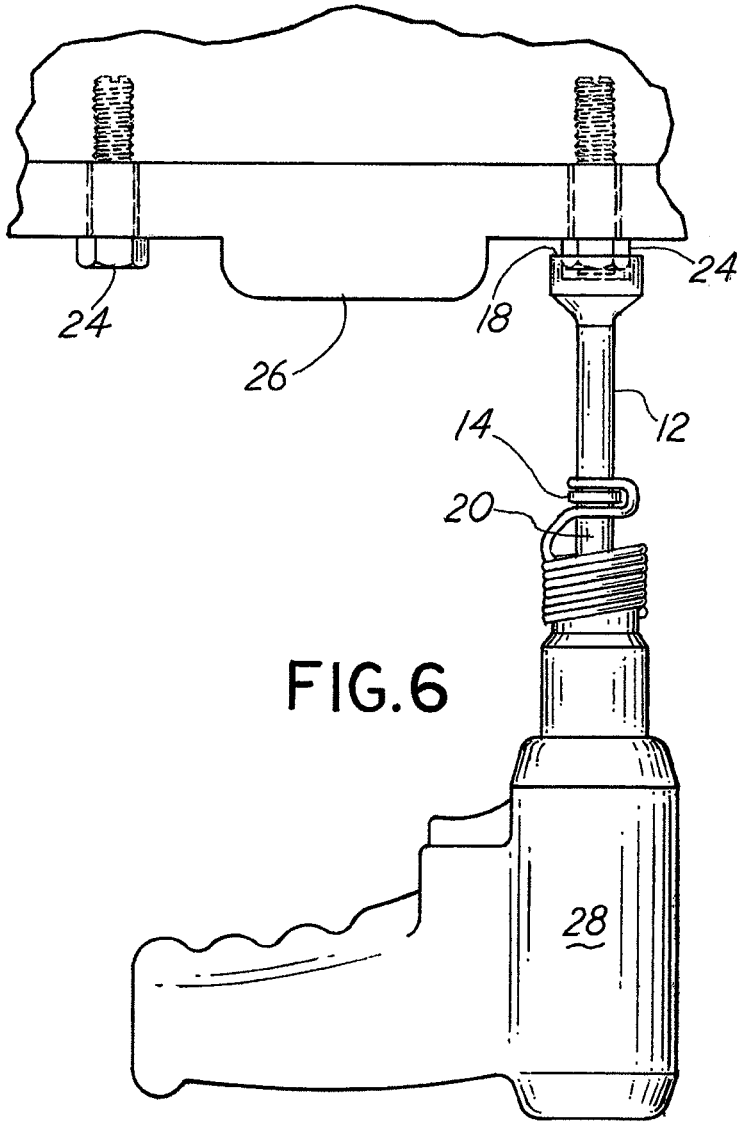
FIG. 6 is a perspective view of the tool of FIG. 1 attached to a pneumatic hammer.

Referring to FIGS. 1-4, there is shown a tool 10 according to an embodiment of the present invention. The tool 10 may be used with a pneumatic hammer 28 as shown in FIG. 6. The tool 10 may be made of steel, typically hardened steel, or any other material capable of providing blows to a bolt head 24, such as tungsten, tungsten alloys (such as tungsten carbide) titanium or the like. The tool 10 may have a main shaft 12 and a stub shaft 20. The stub shaft 20 may fit into a power tool, such as the pneumatic hammer 28. A front end 18 of the tool 10 may have an opening 22 sized to fit about the bolt head 24. The tool 10 may be configured with various sized and shaped openings 22. For example, the opening 22 may fit metric and standard sized bolt heads. The opening 22 may be shaped to fit hex heads (as shown in FIG. 2), twelve point heads, or the like.

The opening 22 at the front end 18 of the tool 10 may have a depth 40 that is less than the height 42 of the bolt head 24. This size feature may prevent a front face 18 of the tool 10 from damaging a component 44 when the tool 10 is in use, as shown in FIG. 6. This arrangement also insures that a raised center 16 will concentrate force on the head of a fastener and thus transfer impact substantially solely to the fastener.

The tool 10 may have a raised center 16 within the opening 22. This raised center 16 may be a raised convex center capable of impacting a center of the bolt head 24, as shown in FIG. 3.

The stub shaft 20 may include a raised tool flare 14 which may facilitate attaching the tool 10 to the pneumatic hammer 28. In one embodiment, the stub shaft 20 may be made to the automotive tool standard 0.401 Parker Taper Shank end designed to be used with many automotive pneumatic hammers.

The tool 10 may be a one-piece design, where a separate tool 10 may be used for each size bolt head 24. In an alternate embodiment, the front end 18 may be removable, fitting on the main shaft 12 by, for example, a typical locking spring loaded detent ball or pin. The tool 10 may have various overall lengths, depending on the application. For example, the main shaft 12 may have a 0.5 inch cross-sectional thickness and may be from about 1 to about 14 inches in length. The main shaft 12 could also be any other shape such as a rod possibly having a hexagonal or square cross section. The stub shaft 20 may be, typically, about 1.3 inches in length with a cross-sectional thickness of about 0.4 inch.

Figure 5:
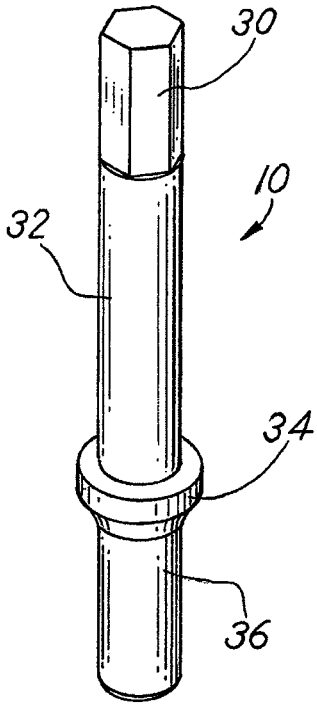
FIG. 5 is a perspective view of an alternate embodiment of the present invention.
Figure 7:
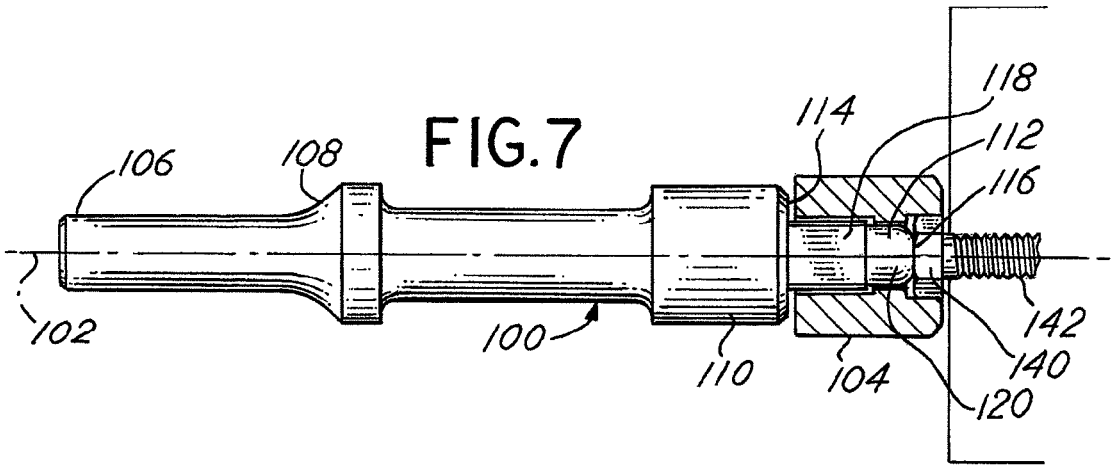
FIG. 7 is a side elevation of another alternate embodiment of the invention wherein a separate drive or driver member or element is depicted for use in combination with a separate socket or socket element component.
Figure 8:
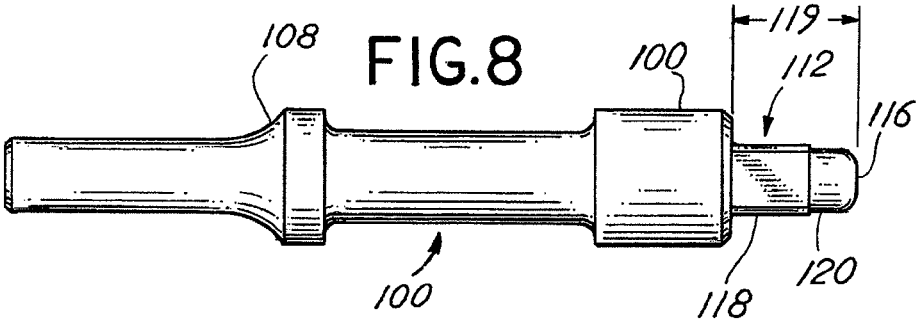
FIG. 8 is a side elevation of a driver element as depicted in the combination of FIG. 7.
Figure 9:
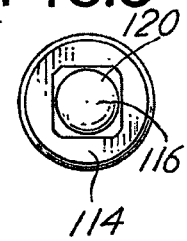
FIG. 9 is an end view of the driver member of FIG. 8.

Referring to FIG. 5, in an alternate embodiment, a tool 10 may have a stub shaft 36, raised tool flare 34 and main shaft 32 similar to the tool 10 described above. A front end 30 of the tool 10, however, may have a shape of an Allen head, for example. In this embodiment, the Allen head front end 30 may fit into an engagement opening in a bolt. The engagement opening may be hexagonal shaped, such as an Allen head bolt (not shown). Alternatively, the front end 30 may have a square shape (not shown) to fit into square drive bolts or a star shape (not shown) to fit into Torx® head bolts.

Referring to FIG. 6, there is shown a method for using the tool 10 according to an embodiment of the invention. The pneumatic hammer 28 may hold the tool 10. The front end 18 of the tool 10 may fit onto the bolt head 24 of a bolt within a component, such as an exhaust manifold 26. By operating the pneumatic hammer 28, the tool 10 may impact the bolt head 24 without becoming disengaged from the bolt head 24.

FIGS. 7-15 disclose another alternate arrangement or embodiment which comprises a set of tools designed to remove headed fasteners. An elongate driver member or driver 100 is formed having a substantially straight axis 102. The driver member 100 is generally symmetrical along axis 102. The driver member 100 is fabricated to cooperate with any one of a separate set of standard size or custom sized socket members, such as socket member 104.

The driver member or driver 100 thus includes a drive end 106 with an integral circumferential shaped rib or flange 108 for engagement by an impact wrench or the like. The driver 100 of FIG. 7 further includes a generally cylindrical forward end 110 with a projecting coaxial, impact rod 112. The rod 112 projects axially from a generally flat planar face or annular surface 114 of the cylindrical forward end 110. The surface 114 is substantially transverse or normal to the axis 102. The projecting impact rod 112 includes an outer face 116 which is configured in the manner previously described with respect to the other embodiments. The impact rod 112 has an initial polygonal (e.g. square) section 118 adjacent the surface 114. The initial section 118 of the impact rod 112 has a square cross section though other cross sectional configurations may be employed. The forward or leading end 120 of the impact rod 112 has a reduced diameter relative to an initial section 118 adjacent the surface 114. The leading end 120 has a cylindrical cross section though other cross sectional configuration may be employed. The distance between surface 114 and the extreme outer end of face 116 defines a first dimension 119.

Each socket, such as socket 104, may be customized to cooperate with a specific size fastener head. For example, referring to FIGS. 10-12, a socket 122 may have a generally external polygonal configuration with a generally configured or cylindrical throughbore 124. Thus the throughbore 124 is typically divided into two or more sections. The socket 122 may include a first inner end 126 and an opposite, outer second end 128. A first section 125 of throughbore 124 is adjacent the first end 126 and has a square cross section. A second section or cylindrical middle section 130 is encompassed in cross section within the first section 125. A polygonal or otherwise configured counterbore section 132 comprising a third section of throughbore 124 is adjacent or at the second or outer end 128. The throughbore 124 is coaxial with respect to the various sections thereof including the first section 125, the second section 130 and the third section or counterbore 132. The first and second sections 125 and 130 may be cylindrical. However, they may be of other configurations that are compatible with the outer configuration of the impact rod 112 of driver 100. The external surface of socket 104 is as discussed heretofore may be polygonal (e.g. hexagonal) which enables manipulation of the socket 104 with a wrench if desired.

A second axial dimension 136 of socket 122 is the distance between the inner first end face 126 and the second end face 128. A third dimension 138 is the axial distance between the inner first end face 126 and the bottom face or surface 133 of the polygonal counterbore 132. The third dimension 138 is less than the second dimension 136. Also, the first dimension 119 or length of the impact rod 112 of the drive member 100 is greater than the third dimension 138 and typically is less than the second dimension 136. The dimensional relationships insure that when an impact socket 122 is placed over the head of a fastener, such as bolt 142, and the projection or impact rod 112 inserted in throughbore 124 of socket 122, the impact rod 112 will extend adequately into and partially through the throughbore 124. The impact rod 112 will reciprocate and engage against the head 140 of a fastener, such as a bolt 142, as the bolt is maintained in counterbore 132. Thus, it is an aspect of the invention that the axial dimensions of the socket 122 as well as the axial dimension of the impact rod 112 relative to the throughbore 124 of the socket 122 be chosen to enable the face 116 of reciprocating impact rod 112 to transfer substantially all impact energy and substantially only engage the head 14 of a bolt or a fastener 142 as the counterbore 132 fits over and retains the socket 122 centered on fastener 142 without permitting the surface 114 of the driver 100 to cause the second surface 128 to be driven or impacted on a component such as 44 in FIG. 3.

Figure 10:
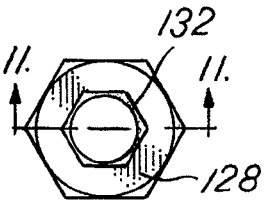
FIG. 10 is a top end plan view of a separate socket element used in combination with a driver element as depicted in FIGS. 8 and 9.
Figure 13:
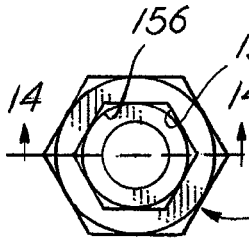
FIG. 13 is a top end plan view of a distinct and separately socket element which may be used in combination with the driver member of FIGS. 8 and 9.
Figure 11:
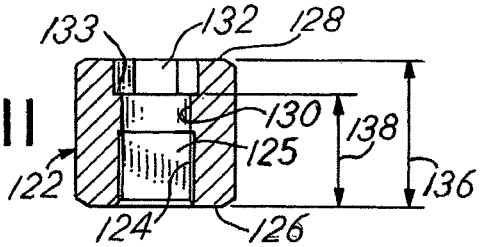
FIG. 11 is a cross sectional view of the socket element of FIG. 10 taken along the line 11-11.
Figure 14:
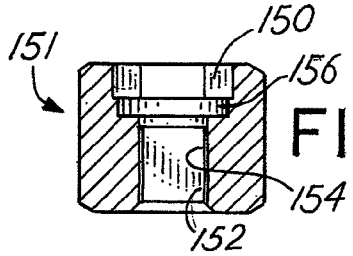
FIG. 14 is a cross sectional view of the socket element of FIG. 13 taken along the line 14-14.
Figure 12:
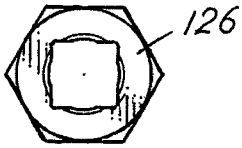
FIG. 12 is a bottom end plan view of the socket of FIG. 10 as viewed from the end opposite FIG. 10.
Figure 15:
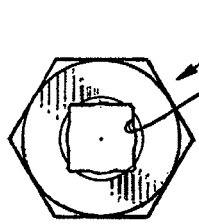
FIG. 15 is a bottom end plan view of the socket of FIG. 13 as viewed from the end opposite FIGS. 13.
Figure 16:
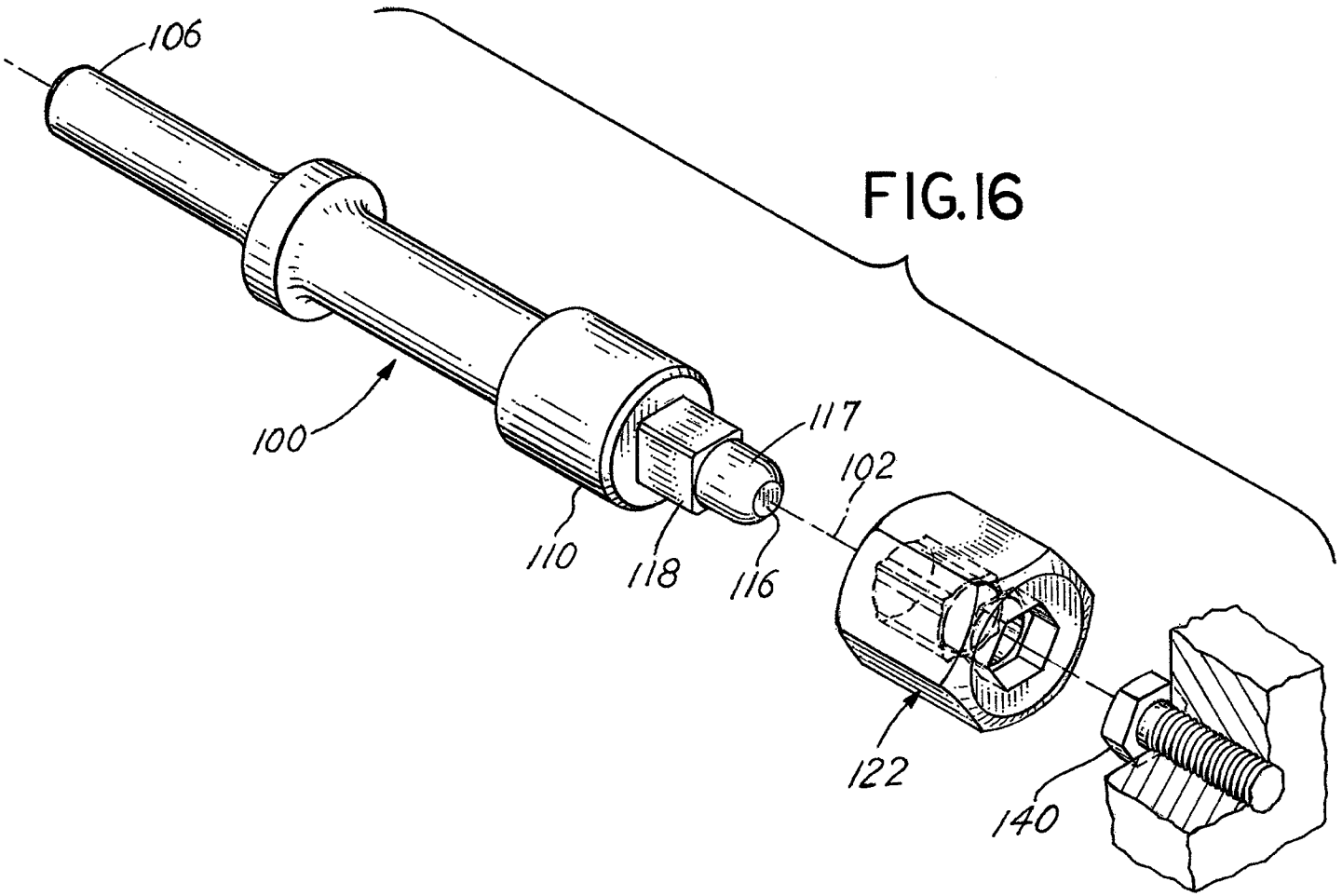
FIG. 16 is an exploded isometric view of the embodiment of FIGS. 7-15.

FIGS. 13-15 depict an alternately sized socket 151 which is separate from the socket element 122 of FIGS. 10-12. The principal distinction is the shape and configuration of a counterbore 150. That is, the throughbore 152 is substantially identical in its first polygonal (square cross section) section 154 which is analogous to the first section 125. However, the configuration and axial dimensions of the remaining sections including a middle section 156 and counterbore section 150 are distinct. As a consequence, the socket element 151 of FIGS. 13-15 is compatible with the driver 100 and may be chosen from a set of distinct socket elements, each having a uniquely shaped and/or sized counterbore section 150, to be compatible with a specific fastener that is to be impacted for removal. A multiple set of sockets may thus be provided wherein each socket may have a unique counterbore configuration or shape including, as previously described, the shape of an Allen wrench, the head of a bolt, and multiple other shapes that are associated with fasteners. Matching a socket with a fastener and placing the socket on the universal driver of the type described thus significantly increases the utility of the tool.

The passage or throughbore 124 as well as the external surface of a socket may thus employ polygonal or cylindrical sections in various combinations. A socket 104 with an external polygonal surface in combination with a throughbore 124 that is, at least in part, polygonal and compatible with a polygonal section of the impact rod 112 may thus be maneuvered by turning or twisting the socket or the driver or driven member 100. The dimensions and configuration of the socket 124, as previously described, insure that the impact end of the rod 112 provides maximum impact energy substantially to the head of a fastener.

It should be understood, of course, that the foregoing relates to exemplary embodiments of the invention and that modifications may be made without departing from the spirit and scope of the invention as set forth in the following claims.

What is claimed is:

1. A tool for engaging and removing a seized fastener comprising:

a driver having a substantially longitudinal axis with a drive end for engaging a head of a fastener and a driven end for driven impact engagement, said drive end including a generally, substantially coaxial forward end with a collar surface generally transverse to the axis, said drive end further including a substantially coaxial, integral, impact rod projecting from said collar surface and terminating with an impact face, said impact rod at least in part generally cylindrical and extending a first axial dimension from said collar surface to said impact face; and a separate socket having an axial throughbore for receipt of said impact rod of said driver, said socket including first and second opposite end faces located at opposite ends of the throughbore, said end faces spaced a second axial dimension and generally transverse to said throughbore axis, said throughbore including a counterbore at said second face end with an axial counterbore depth surface generally transverse to the axis and a cross sectional configuration for receiving the head of a fastener whereby the distance between the first end and the counterbore depth surface defines a third axial dimension, said third axial dimension less than said first axial dimension of said impact rod enabling said impact rod of said driver to be insertable into said socket throughbore for reciprocal movement and engagement of said face of said impact rod with the head of a fastener positioned in said socket counterbore.

2. The tool of claim 1 wherein said collar surface is normal to said axis and generally flat.

3. The tool of claim 2 wherein said socket throughbore is in part generally cylindrical.

4. The tool of claim 3 wherein said socket counterbore has a generally polygonal cross section.

5. The tool of claim 2 wherein said socket counterbore has a generally polygonal cross section transverse to the socket axis.

6. The tool of claim 1 wherein said socket throughbore is generally cylindrical at least in part between said first end and said counterbore.

7. The tool of claim 1 wherein said socket counterbore has a generally polygonal cross section transverse to the socket axis.

8. The tool of claim 1 wherein a fastener is mounted on a component, and said second axial dimension between said first and second faces is greater than the first axial dimension of said impact rod and less than the axial distance between the collar surface and the component upon placement of the tool on a fastener in said component.

9. The impact tool of claim 8 wherein the socket counterbore is polygonal.

10. The impact tool of claim 8 wherein the socket counterbore is polygonal and the remainder of the throughbore is at least in part polygonal.

11. The impact tool of claim 1 wherein the socket throughbore is at least in part polygonal.

12. A method for engaging and removing a seized fastener comprising the steps of:

(a) providing a tool which includes a driver having a substantially longitudinal axis with a drive end for engaging a head of a fastener and a driven end for impact engagement, said drive end including a generally, substantially coaxial forward end with a collar surface generally transverse to the axis, said drive end further including a substantially coaxial, integral, impact rod projecting from said collar surface and terminating with a face generally transverse to the axis, said impact rod at least in part generally cylindrical and extending a first axial dimension from said collar surface to said face, and a set of separate sockets, each socket having first and second opposite generally transverse end surfaces with an axial throughbore for receipt of said impact rod of said driver and including a counterbore at said second end surface with a cross sectional configuration for compatibly engaging the head of a fastener, said axial throughbore having a second axial dimension between the first end surface and a counterbore depth surface said less than said first axial dimension of said impact rod, whereby said impact rod of said driver is insertable into said socket throughbore for reciprocal movement and engagement of said face of said impact rod with the head of a fastener positioned in said socket counterbore and wherein the counterbore configuration of each socket member is distinctly sized for a distinctly headed fastener;

(b) placing one of said set of socket members on said impact rod by inserting said rod into said socket throughbore with the counterbore axially spaced from the coaxial collar surface;

(c) fitting said counterbore of said selected socket member on a head of a fastener compatible therewith; and (d) impacting said impact rod face on said fastener head to loosen said fastener.

13. A tool for engaging and removing a seized fastener comprising:

a driver having a substantially longitudinal axis with a drive end for engaging a head of a fastener and a driven end for driven impact engagement, said drive end including a generally, substantially coaxial forward end with a collar surface generally transverse to the axis, said drive end further including a substantially coaxial, integral, impact rod projecting from said collar surface and terminating with an impact face, said impact rod extending a first axial dimension from said collar surface to said impact face; and a separate socket having an axial socket throughbore for receipt of said impact rod of said driver, said socket including first and second opposite end faces located at opposite ends of the throughbore, said end faces spaced a second axial dimension and generally transverse to said throughbore axis, said throughbore including a counterbore at said second face end with an axial counterbore depth surface generally transverse to the axis and a cross sectional configuration for receiving the head of a fastener whereby the distance between the first end and the counterbore depth surface defines a third axial dimension, said third axial dimension less than said first axial dimension of said impact rod enabling said impact rod of said driver to be insertable into said socket throughbore for reciprocal movement and engagement of said face of said impact rod with the head of a fastener positioned in said socket counterbore, said socket throughbore being generally cylindrical at least in part between said first end and said counterbore.

14. The tool of claim 13 wherein said collar surface is normal to said axis and generally flat.

15. The tool of claim 14 wherein said socket counterbore has a generally polygonal cross section transverse to the socket axis.

16. The tool of claim 14 wherein said socket counterbore has a generally polygonal cross section.

17. The tool of claim 14 wherein a fastener is mounted on an element surface, and said second axial dimension between said first and second faces is greater than the second axial dimension of said impact rod and less than the axial distance between the collar surface and element surface upon placement of the tool on the fastener.

18. The tool of claim 13 wherein said impact rod is at least in part generally cylindrical.

19. The tool of claim 13 said socket throughbore is in part generally cylindrical.

20. The tool of claim 13 wherein said socket counterbore has a generally polygonal cross section transverse to the socket axis.

21. The tool of claim 13 wherein said socket counterbore has a generally polygonal cross section transverse to the socket axis.

22. The tool of claim 13 wherein said socket counterbore has a generally polygonal cross section.

23. The tool of claim 13 wherein a fastener is mounted on an element surface, and said second axial dimension between said first and second faces is greater than the second axial dimension of said impact rod and less than the axial distance between the collar surface and element surface upon placement of the tool on the fastener.

24. The impact tool of claim 23 wherein the socket throughbore is at least in part polygonal.

25. The impact tool of claim 23 wherein the socket counterbore is polygonal.

26. The impact tool of claim 23 wherein the socket counterbore is polygonal and the remainder of the socket throughbore is at least in part polygonal.

27. The tool of claim 13 wherein said socket throughbore is in part generally cylindrical.

28. The tool of claim 13 wherein said socket counterbore has a generally polygonal cross section transverse to the socket axis.

29. The tool of claim 13 wherein said socket counterbore has a generally polygonal cross section transverse to the socket axis.

30. The tool of claim 13 wherein said socket counterbore has a generally polygonal cross section.

31. The tool of claim 13 wherein a fastener is mounted on a component, and said second axial dimension between said first and second faces is greater than the first axial dimension of said impact rod and less than the axial distance between the collar surface and the component upon placement of the tool on a fastener in said component.

32. The impact tool of claim 13 wherein the socket throughbore is at least in part polygonal.

33. A tool for engaging and removing a seized fastener comprising:

a driver having a substantially longitudinal axis with a drive end for engaging a head of a fastener and a driven end for driven impact engagement, said drive end including a generally, substantially coaxial forward end with a generally flat collar surface normal to the axis, said drive end further including a substantially coaxial, integral, impact rod projecting from said collar surface and terminating with an impact face, said impact rod extending a first axial dimension from said collar surface to said impact face; and a separate socket having an axial throughbore for receipt of said impact rod of said driver, said socket including first and second opposite end faces located at opposite ends of the throughbore, said end faces spaced a second axial dimension and generally transverse to said throughbore axis, said throughbore including a counterbore at said second face end with an axial counterbore depth surface generally transverse to the axis and a cross sectional configuration for receiving the head of a fastener whereby the distance between the first end and the counterbore depth surface defines a third axial dimension, said third axial dimension less than said first axial dimension of said impact rod enabling said impact rod of said driver to be insertable into said socket throughbore for reciprocal movement and engagement of said face of said impact rod with the head of a fastener positioned in said socket counterbore, said socket throughbore being at least in part generally cylindrical.

34. The tool of claim 33 wherein said socket throughbore is generally cylindrical at least in part between said first end and said socket counterbore.

35. The tool of claim 33 wherein said socket throughbore is generally cylindrical at least in part between said first end and said counterbore.

36. The tool of claim 33 wherein said socket counterbore has a generally polygonal cross section transverse to the socket axis.

37. The tool of claim 33 wherein said socket counterbore has a generally polygonal cross section transverse to the socket axis.

38. The tool of claim 33 wherein said socket counterbore has a generally polygonal cross section.

39. The tool of claim 33 wherein a fastener is mounted on a component, and said second axial dimension between said first and second faces is greater than the first axial dimension of said impact rod and less than the axial distance between the collar surface and the component upon placement of the tool on a fastener in said component.

40. The impact tool of claim 33 wherein the socket throughbore is at least in part polygonal.

41. The tool of claim 33 wherein said impact rod is at least in part generally cylindrical.

42. The tool of claim 33 wherein said socket counterbore has a generally polygonal cross section transverse to the socket axis.

43. The tool of claim 33 wherein said socket counterbore has a generally polygonal cross section transverse to the socket axis.

44. The tool of claim 33 wherein said socket counterbore has a generally polygonal cross section.

45. The tool of claim 33 wherein a fastener is mounted on an element surface, and said second axial dimension between said first and second faces is greater than the second axial dimension of said impact rod and less than the axial distance between the collar surface and element surface upon placement of the tool on the fastener.

* * * * *